US007308224B2

(12) United States Patent
Yamada

(10) Patent No.: US 7,308,224 B2
(45) Date of Patent: Dec. 11, 2007

(54) IMAGE FORMING APPARATUS AND METHOD OF CONTROLLING IMAGE FORMING APPARATUS

(75) Inventor: Naoto Yamada, Kawasaki (JP)

(73) Assignee: Canon Kabushiki Kaisha (JP)

( * ) Notice: Subject to any disclaimer, the term of this patent is extended or adjusted under 35 U.S.C. 154(b) by 201 days.

(21) Appl. No.: 11/241,770

(22) Filed: Sep. 30, 2005

(65) Prior Publication Data

US 2006/0072942 A1 Apr. 6, 2006

(30) Foreign Application Priority Data

Oct. 1, 2004 (JP) ..... 2004-290381

(51) Int. Cl.
*G03G 15/01* (2006.01)

(52) U.S. Cl. ..... 399/301; 399/66; 399/302

(58) Field of Classification Search ..... 399/301, 399/302, 162, 394, 51, 66; 347/116
See application file for complete search history.

(56) References Cited

U.S. PATENT DOCUMENTS 6,301,451 B1 * 10/2001 Ando et al. ..... 399/301 X
2004/0184827 A1 * 9/2004 Yamada ..... 399/66 X

FOREIGN PATENT DOCUMENTS

JP 10-123846 A 5/1998

* cited by examiner

*Primary Examiner*—Sophia S. Chen
(74) *Attorney, Agent, or Firm*—Rossi, Kimms & McDowell. LLP

(57) ABSTRACT

An image forming apparatus for overlaying toner images of at least two colors on an image carrier, and forming the toner images on a printing medium, counts the perimeter of the image carrier on the basis of a reference signal and a sampling period of a clock count, and sets target values of image formation start timings for respective colors in consideration of a perimeter error of the image carrier due to a quantization error produced upon counting on the basis of the reference signal and the sampling period of the clock count.

14 Claims, 16 Drawing Sheets

FIG. 16

| | ITEM 1 | ITEM 2 | ITEM 3 | ITEM 4 | ITEM 5 |
|---|---|---|---|---|---|
| COMBINATION | INTEGER VALUES CLOSE TO TRISECTIONS | SUM VALUES OF ITEM 1 | PERIMETER COUNT SUM VALUES OF INTERMEDIATE TRANSFER BELT BEFORE QUANTIZATION ERROR CORRECTION | ERROR AFTER QUANTIZATION ERROR CORRECTION \| ITEM 3 − ITEM 2 \| | WHETHER OR NOT ERROR AFTER QUANTIZATION ERROR CORRECTION FALLS WITHIN ONE QUANTIZATION ERROR \| ITEM 3 − ITEM 2 \| < 1 |
| 1 | 100 | 100 | 100.6 | 0.6 | × |
| | 100 | 200 | 201.2 | 1.2 | |
| | 101 | 301 | 301.8 | 0.8 | |
| 2 | 100 | 100 | 100.6 | 0.6 | OPTIMAL COMBINATION VALUES |
| | 101 | 201 | 201.2 | 0.2 | |
| | 100 | 301 | 301.8 | 0.8 | |
| 3 | 101 | 101 | 100.6 | −0.4 | OPTIMAL COMBINATION VALUES |
| | 100 | 201 | 201.2 | 0.2 | |
| | 100 | 301 | 301.8 | 0.8 | |

IMAGE FORMING APPARATUS AND METHOD OF CONTROLLING IMAGE FORMING APPARATUS

FIELD OF THE INVENTION

The present invention relates to an electrophotographic image forming apparatus such as a copying machine, printer, or the like and, more particularly, to an image forming apparatus using an intermediate transfer body and its control method.

BACKGROUND OF THE INVENTION

An electrophotographic image forming apparatus primarily transfers a toner image formed on a photosensitive body onto an intermediate transfer body, then secondarily transfers the toner image onto a printing medium such as a paper sheet, and fixes the toner image on the printing medium, thus obtaining a toner image. The intermediate transfer body may have a drum or belt shape. Since the belt-shaped intermediate transfer body is advantageous in term of space, a size reduction of the image forming apparatus can be attained.

In order to obtain a full-color image by an image forming apparatus that uses an intermediate transfer belt, toner images of three colors, i.e., yellow, cyan, and magenta, or four colors also including black in addition to these three colors, are primarily transferred in turn from a photosensitive body into the intermediate transfer belt, and a full-color toner image overlaid on the intermediate transfer belt is secondarily transferred onto a printing medium at the same time.

In this case, if the overlaying positions of the toner images of the three or four colors deviate from each other, the tint or the like of the obtained image becomes different from the original image or the like. For this reason, in order to obtain high image quality of the full-color image, multi-color toner images to be overlaid on the intermediate transfer belt must be accurately aligned.

As an example of aligning the overlaying positions of the multi-color toner images on the intermediate transfer belt, a method of forming an image by measuring the perimeter of the intermediate transfer body is known. According to Japanese Patent Laid-Open No. 10-123846, in order to measure the belt perimeter of the intermediate transfer body, a mark is formed on the intermediate transfer body and is detected from the rotating intermediate transfer body in advance, and the belt perimeter is calculated based on the detection time interval (mark detection period) and the velocity of the intermediate transfer body.

However, in order to count the mark detection period, when a counter or the like is provided to execute sampling based on counter source clocks, that sampling period is reflected on the belt perimeter value as a quantization error (perimeter error). When color overlaying processes are executed on the basis of the belt perimeter value including the quantization error, quantization errors are accumulated for three rotations of the intermediate transfer body, i.e., those for the first color→the second color, the second color→the third color, and the third color→the fourth color. As a result, at the final transfer position of the fourth color, the quantization errors (=quantization error×3) of the belt perimeter value for three rotations influence color misregistration at the transfer position.

SUMMARY OF THE INVENTION

The present invention has been made in consideration of the above situation, and has as its object to provide an image forming apparatus and a method of controlling the image forming apparatus, which can generate image top signals for respective colors in nearly synchronism with actual image formation start timings by distributing a quantization error produced by a sampling period based on counter source clocks within one quantization error for at least one color.

In order to achieve the above object, an image forming apparatus according to the present invention is characterized by mainly having the following arrangement.

According to the present invention, the above object is attained by providing an image forming apparatus for overlaying toner images of at least two colors on an image carrier, and forming the toner images on a printing medium, comprising:

a perimeter count device adapted to count a perimeter of the image carrier on the basis of a reference signal and a sampling period of a clock count; and a target value setting device adapted to set target values of image formation start timings for respective colors in consideration of a perimeter error of the image carrier due to a quantization error produced upon counting on the basis of the reference signal and the sampling period of the clock count.

According to the present invention, the above object is attained by providing an image forming apparatus for forming a toner image on an image carrier, overlaying the toner images of at least two colors on an intermediate transfer body, and forming an image on a printing medium, comprising:

a perimeter count device adapted to count a perimeter of the intermediate transfer body on the basis of a reference signal and a sampling period of a clock count; and a target value setting device adapted to set target values of image formation start timings for respective colors in consideration of a perimeter error of the intermediate transfer body produced upon counting on the basis of the reference signal and the sampling period of the clock count.

Alternatively, in order to achieve the above object, a method of controlling an image forming apparatus according to the present invention is characterized by mainly having the following arrangement.

According to the present invention, the above object is attained by providing a method of controlling an image forming apparatus for overlaying toner images of at least two colors on an image carrier, and forming the toner images on a printing medium, comprising:

a perimeter count step of counting a perimeter of the image carrier on the basis of a reference signal and a sampling period of a clock count; and a target value setting step of setting target values of image formation start timings for respective colors in consideration of a perimeter error of the image carrier due to a quantization error produced upon counting on the basis of the reference signal and the sampling period of the clock count.

According to the present invention, the above object is attained by providing a method of controlling an image forming apparatus for forming a toner image on an image carrier, overlaying the toner images of at least two colors on an intermediate transfer body, and forming an image on a printing medium, comprising:

a perimeter count step of counting a perimeter of the intermediate transfer body on the basis of a reference signal and a sampling period of a clock count; and a target value setting step of setting target values of image formation start timings for respective colors in consideration of a perimeter error of the intermediate transfer body due to a quantization error produced upon counting on the basis of the reference signal and the sampling period of the clock count.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 16 is a table showing practical numerical values used to explain the processing shown in FIG. 15.

DETAILED DESCRIPTION OF THE PREFERRED EMBODIMENTS

Preferred embodiments of the present invention will now be described in detail in accordance with the accompanying drawings.

The above objects and effects, and other objects and effects of the present invention will become apparent from the following description. Preferred embodiments of the present invention will be described in detail hereinafter with reference to the accompanying drawings.

First Embodiment

<Arrangement of Image Forming Apparatus>

Figure 1:
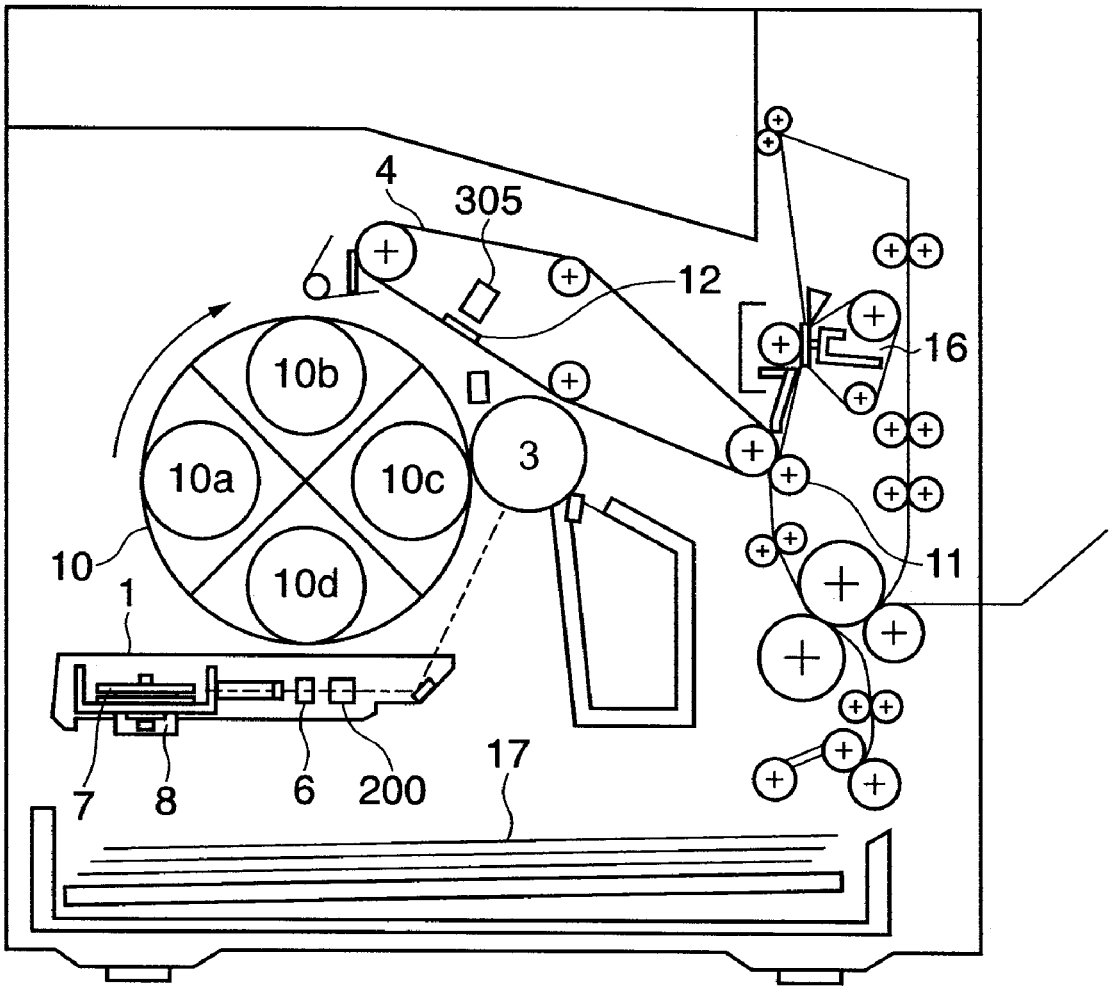
FIG. 1 is a sectional view showing an image forming apparatus having an intermediate transfer drum according to the first and second embodiments of the present invention.

FIG. 1 shows an image forming apparatus having an intermediate transfer drum according to this embodiment. Color registration of respective colors, i.e., yellow (Y), magenta (M), cyan (C), and black (BK) in the sub-scan direction (convey direction of a printing medium such as a printing sheet or the like) in the image forming apparatus will be described below with reference to FIG. 1.

Referring to FIG. 1, a scanner unit 1 includes a laser unit 6 which emits a light beam such as a laser beam or the like that is modulated on the basis of an image signal output from an image forming unit 27 shown in FIG. 11 (to be described later), a polygonal mirror (to be referred to as "polygon mirror" hereinafter) 7 for forming an electrostatic latent image on a photosensitive drum 3 by deflecting the laser beam from the laser unit 6 and scanning the photosensitive drum 3 with the laser beam, a scanner motor 8 for rotating the polygon mirror 7, a beam detect signal (BD signal) generation circuit 200 for detecting a laser beam in the main scan direction (a direction perpendicular to the plane of page) deflected by the polygon mirror 7, and the like.

A developer rotary 10 develops the electrostatic latent image formed on the photosensitive drum 3 by Y, M, C, and BK toner units 10*a*, 10*b*, 10*c*, and 10*d*. Each toner image on the photosensitive drum 3 developed by the developer rotary 10 is primarily transferred onto an intermediate transfer belt 4. A secondary transfer roller 11 contacts the intermediate transfer belt 4 to secondarily transfer the toner image on the intermediate transfer belt 4 onto a printing sheet 17. A perimeter detection sensor 305 detects the perimeter of the intermediate transfer belt, and uses, for example, an optical reflection sensor. When the perimeter detection sensor 305 is arranged at a position inside the intermediate transfer belt 4, it irradiates a reference mark 12 (e.g., a sticker of a material with a high reflectance) on the back surface of the intermediate transfer belt with light coming from an LED, detects the light reflected by the mark 12, and measures the rotation velocity of the intermediate transfer belt 4 and the detection time interval (period) of the reference mark 12. A CPU 306 (FIG. 2) calculates the perimeter of the intermediate transfer belt 4 on the basis of this period. A process for calculating the perimeter will be described in detail later.

The perimeter detection sensor 305 continuously detects rotations of the intermediate transfer belt 4 for at least two periods.

<Arrangement of Perimeter Detection Counter>

Figure 2:
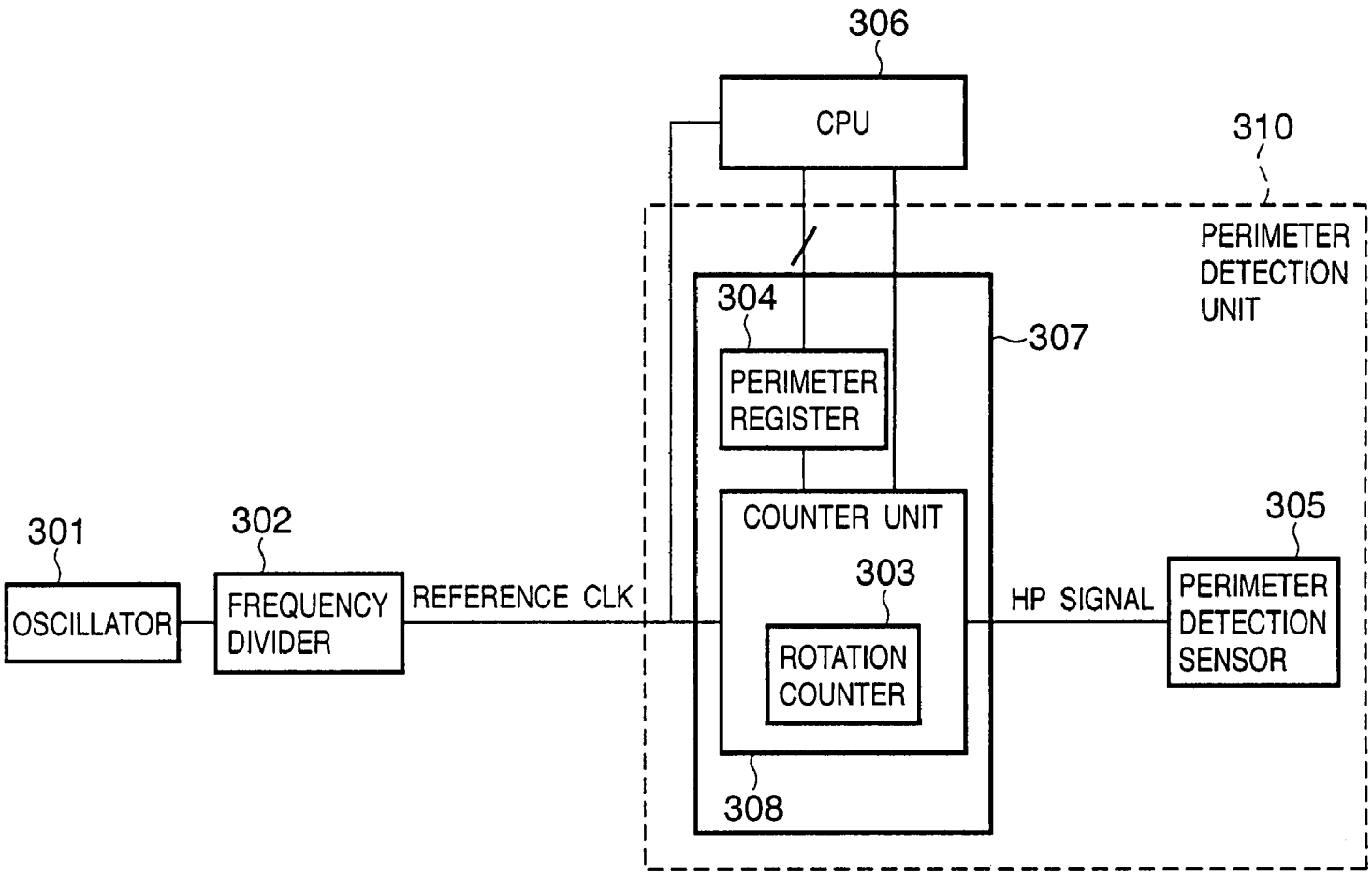
FIG. 2 is a block diagram showing the arrangement of a perimeter detection counter.

FIG. 2 is a block diagram showing the arrangement of a perimeter detection counter. Source clocks of an oscillator 301 are input to a frequency divider 302. The frequency divider 302 generates reference clocks (CLK) for a perimeter detection counter 307 on the basis of the input source clocks.

The perimeter detection counter 307 is connected to the CPU 306. The CPU 306 can always read a counter value loaded onto a perimeter register 304 via a bus, and generates an enable signal of a counter unit 308.

The CPU 306 controls the counter unit 308 and the like to re-set a target value of the counter for each rotation of the intermediate transfer belt 4 on the basis of the read counter value, thereby preventing accumulation of errors.

The counter unit 308 begins to count in response to the enable signal from the CPU 306 and the detection signal from the perimeter detection sensor 305 as trigger signals. The counter unit 308 increments a rotation counter 303 every time it receives the next detection signal. When the counter unit 308 receives the detection signal after the value of the rotation counter 303 reaches a target value (e.g., for three rotations in this embodiment), the counter value of the counter unit 308 so far is loaded onto the perimeter register 304, and the counter unit 308 is cleared to repeat re-counting.

<Setting of Target Value>

The value "for three rotations" described as the target value in the description of FIG. 2 does not limit the contents of an embodiment according to the present invention, but it may correspond to the belt rotation period of the intermediate transfer body measured to generate image formation start signals for at least two colors.

Figure 3:
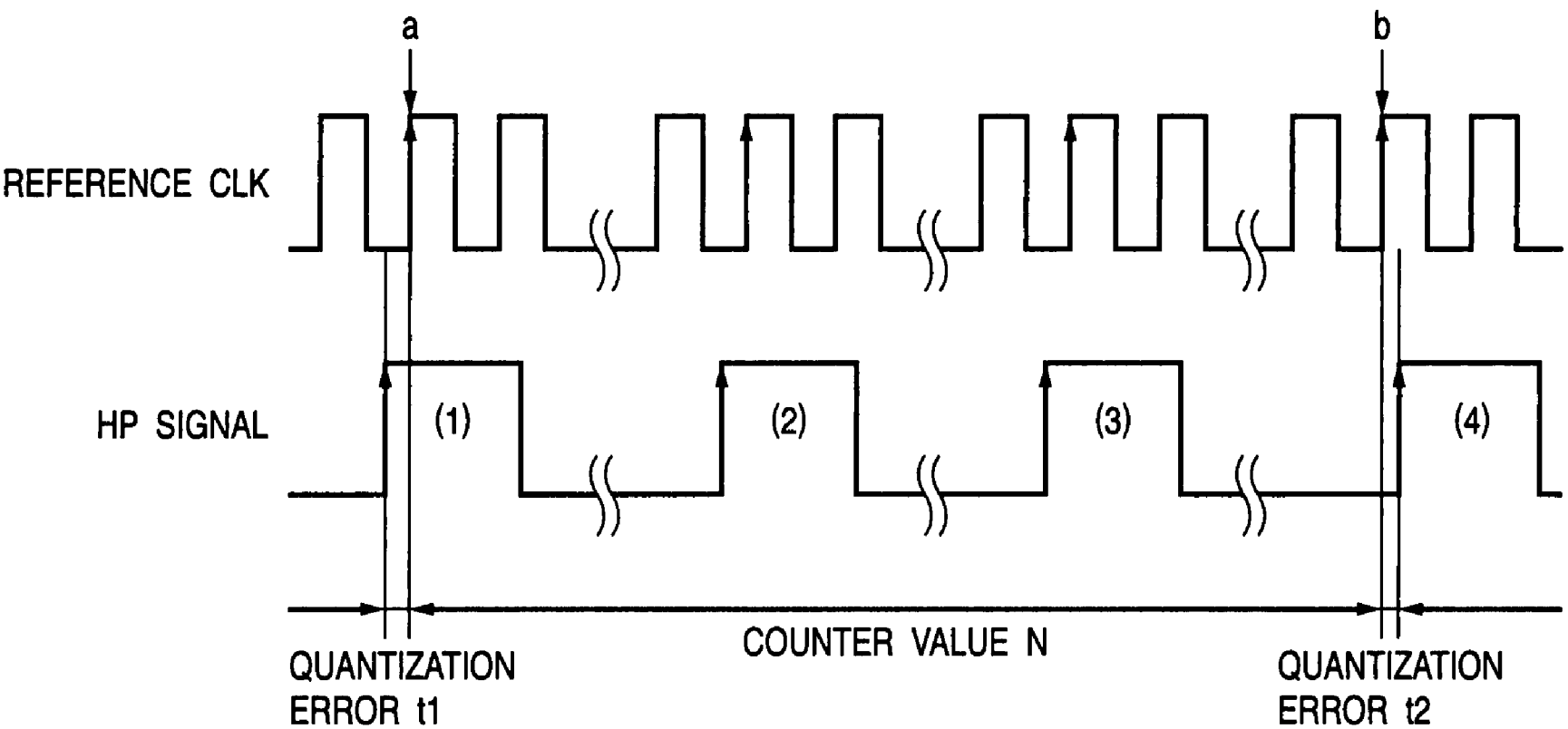
FIG. 3 is a chart for explaining the operation of the perimeter detection counter.

FIG. 3 is a chart for explaining the operation of the perimeter detection counter 307.

A practical target value setting sequence will be described below together with the operation of the perimeter detection counter 307 shown in FIG. 3.

The reference mark 12 formed on the back surface of the intermediate transfer belt 4 is detected by the perimeter detection sensor 305, and its detection signal (HP signal) is input to the rotation counter 303. Counting starts in response to the first reference clock (CLK) ("a" in FIG. 3) input to the counter unit 308 after the leading edge of the detection signal of the perimeter detection sensor 305.

When the intermediate transfer belt 4 further rotates, and the perimeter detection sensor 305 detects the reference mark 12 again, the detection signal (HP signal) is input to the rotation counter 303. In this manner, finally, the intermediate transfer belt 4 makes three rotations (when three periods are set as a target value), and the counter unit 308 counts the number of reference clocks up to a reference clock ("b" in FIG. 3) immediately before the fourth detection signal counted from the first detection signal (HP signal) is input and loads a counter value (N) to the perimeter register 304.

Based on the counter value (N) obtained in this manner, the belt perimeter for three periods of the intermediate transfer belt 4 can be measured at a resolution unit of the reference clocks. The perimeter of the intermediate transfer belt 4 can be calculated based on the counter value (N) and belt rotation velocity upon image formation.

The CPU 306 sets target values of respective colors to be input to ITOP signal generation counters for respective colors by equally dividing the counter value (N) for three rotations of the intermediate transfer belt 4 into three (M if M periods ($M \geqq 2$) are set as a target value). In practice, the counter value for three periods may not be a value that cannot be equally divided into three. In this case, the target values to be input to the ITOP signal generation counters for respective colors are appropriately set to suppress a quantization error (t1+t2 in case of FIG. 3) to at least less than one quantization error in color registrations of four colors in a resolution unit of the reference clocks used to count the belt perimeter. The ITOP signal generation counters are explained hereafter by referencing the counter circuit 31 of FIG. 5.

A perimeter detection unit 310 comprises the perimeter detection counter 307 which includes the counter unit 308 (including the rotation counter 303) and the perimeter register 304, and the perimeter detection sensor 305.

Even when the image top position (image formation start position) of each color is merely accurately synchronized, if an image top position signal (ITOP signal) indicating the write start position of each color in the sub-scan direction obtained by rotation of the intermediate transfer belt 4 is not synchronized with a beam detect signal (BD signal) indicating each write start position of the main scan direction obtained by rotation of the scanner motor 8, the write start position of each color in the sub-scan direction is likely to deviate for a phase difference of the image top signal for each color and the BD signal, i.e., a maximum of one line in the sub-scan direction. This deviation can be solved if the time period (period) required for the intermediate transfer belt 4 to make one rotation is an integer multiple of the period of BD signals (BD signal period) indicating each write start position of the main scan direction. However, it is often difficult to set one rotation period of the intermediate transfer belt 4 to be an integer multiple of the BD signal period since limitations are imposed on the apparatus design.

In this embodiment, a target value signal (a counter target value to be described in detail later) as a reference corresponding to the position of the polygon mirror 7 on the scanner motor 8 is re-generated for each rotation of the intermediate transfer belt 4. Then, a multi-color image forming apparatus which can completely remove color misregistration of respective colors by synchronizing the image top position signal (ITOP signal) that indicates the image formation start position and the beam detect signal (BD signal) using an arrangement for controlling rotation of the scanner motor 8 by applying phase control to the target value signal can be provided.

<Control Arrangement Associated with Scanner Motor 8>

Figure 11:
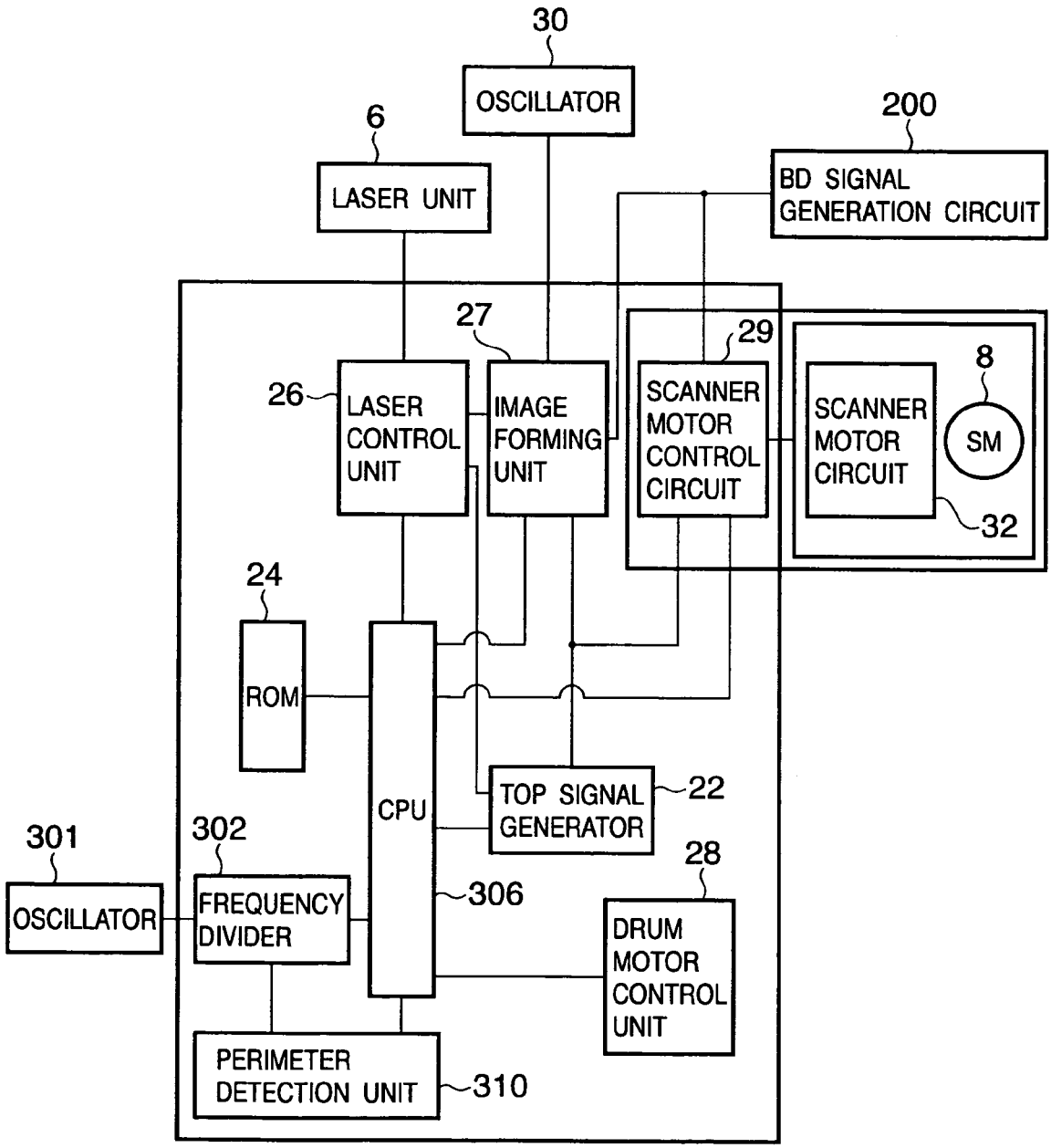
FIG. 11 is a block diagram for explaining the control arrangement associated with a scanner motor 8.

FIG. 11 is a block diagram for explaining the control arrangement associated with the scanner motor 8. Referring to FIG. 11, the CPU 306 controls the overall image forming apparatus on the basis of a program stored in a ROM 24. A drum motor control unit 28 controls rotation and stop of the intermediate transfer belt 4 and photosensitive drum 3. A top signal generator 22 electrically generates an ITOP signal (image top signal) for each color in actual print processing by starting up the frequency divider and the like on the basis of the predetermined number of steps per rotation and one step period time. Assume that the CPU 306 has a memory RAM (not shown) as its work area inside the CPU 306 or on another area.

The frequency divider 302 generates clocks as a reference time of the operation of the CPU 306 on the basis of the source clock oscillator 301.

The ROM 24 is a memory which stores a series of control processes of the CPU 306 as a program. In general, if a one-chip CPU is used, a size reduction and cost reduction of the CPU 306, drum motor control unit 28, top signal generator 22, frequency divider 302, and ROM 24 integrated in one chip can be attained.

A scanner motor circuit 32 and scanner motor control circuit 29 control rotation/stop of the scanner motor 8 which rotates the polygon mirror 7 on the basis of a command from the CPU 306. The beam detect signal (BD signal) generation circuit 200 (see FIG. 1) generates a beam detect signal (BD signal) serving as a start reference signal of the main scan direction (sync signal of the main scan direction) by detecting a laser beam deflected upon rotation of the polygon mirror 7. As the beam detect signal (BD signal), if a polygonal mirror with six faces is used, six beam detect signals (BD signals) are generated per rotation of the scanner motor 8.

An oscillator 30 generates reference clocks used to operate the image forming unit (image formation control circuit) 27. The image formation control circuit 27 has a sub-scan control circuit and main scan control circuit, controls the timings for video data formation via a communication with a controller (not shown), synchronizes the main scan and sub-scan timings on the basis of the image top signal (ITOP signal) generated by the top signal generator 22 and the beam detect signal (BD signal), and generates a laser emission signal according to a video signal.

A laser control unit 26 controls laser driving by synchronizing respective colors in the sub-scan direction on the basis of a print command of the CPU 306, the laser emission signal generated by the image formation control circuit 27, or the top signal generated by the top signal generator 22.

The laser unit 6 writes latent image data on the photosensitive drum 3 with a laser beam upon reception of the signal from the laser control unit 26.

The scanner motor control circuit 29 comprises a control circuit which controls to remove a phase difference from an actual BD signal by generating a reference BD signal as a reference immediately after the electrical image top signal (ITOP signal) is generated.

The perimeter detection unit 310 is a unit described in FIG. 2.

<Arrangement of Scanner Motor Control Circuit 29>

Figure 12:
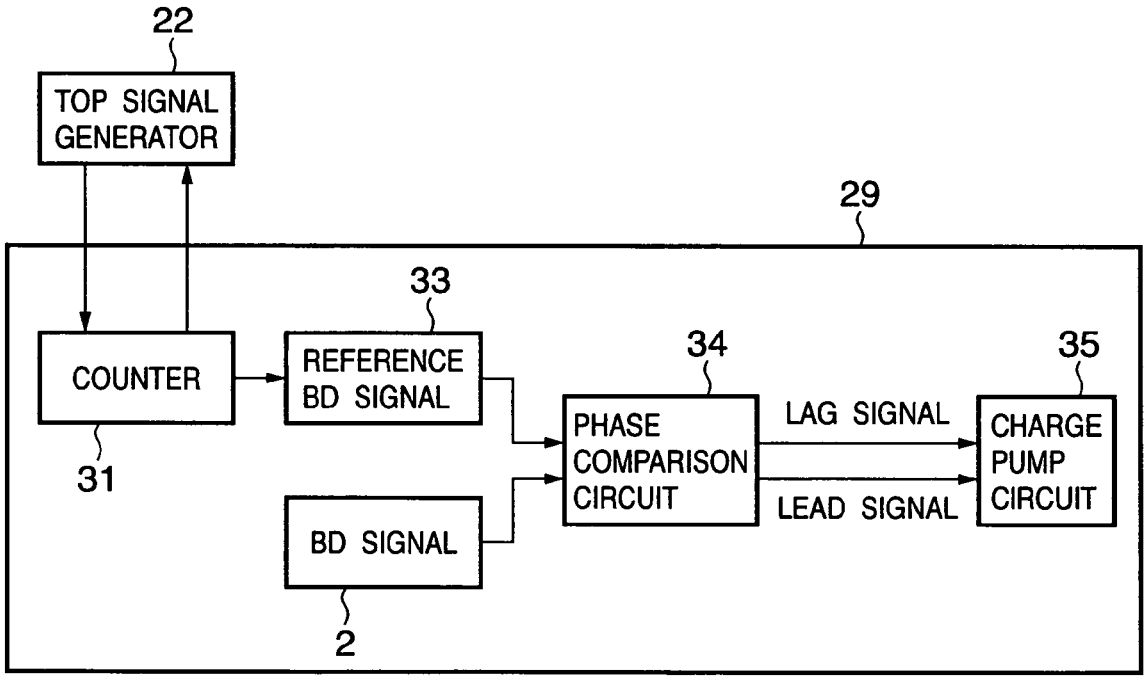
FIG. 12 is a block diagram showing the arrangement of a scanner motor control circuit 29 shown in FIG. 11 in detail.

FIG. 12 is a block diagram showing the arrangement of the scanner motor control circuit 29 shown in FIG. 11 in detail. The same reference numerals in FIG. 12 denote the same parts as in FIG. 11.

A counter 31 generates and outputs a video data request signal when a predetermined count time is reached. The top signal generator 22 outputs a ITOP signal in accordance with the video data request signal of the counter 31.

The counter 31 has an arrangement that resets a counter value to generate a reference BD signal immediately after the output (ITOP signal) of the top signal generator 22 is detected, and re-generates a reference BD signal.

A phase comparison circuit 34 compares the phases of a reference BD signal 33 and an actual BD signal 2 generated by the beam detect signal (BD signal) generation circuit 200, and outputs a LAG signal and LEAD signal (to be described later).

A charge pump circuit 35 converts a phase difference into a control voltage upon reception of the output signals from the phase comparison circuit 34. In this case, a proportional action is made directly using the time period of the phase difference as a controlled variable. The charge pump circuit 35 generates a "+"/"−" control voltage as a constant voltage in accordance with "lead"/"lag" of the phase difference.

<Arrangement of Scanner Motor Circuit 32>

Figure 13:
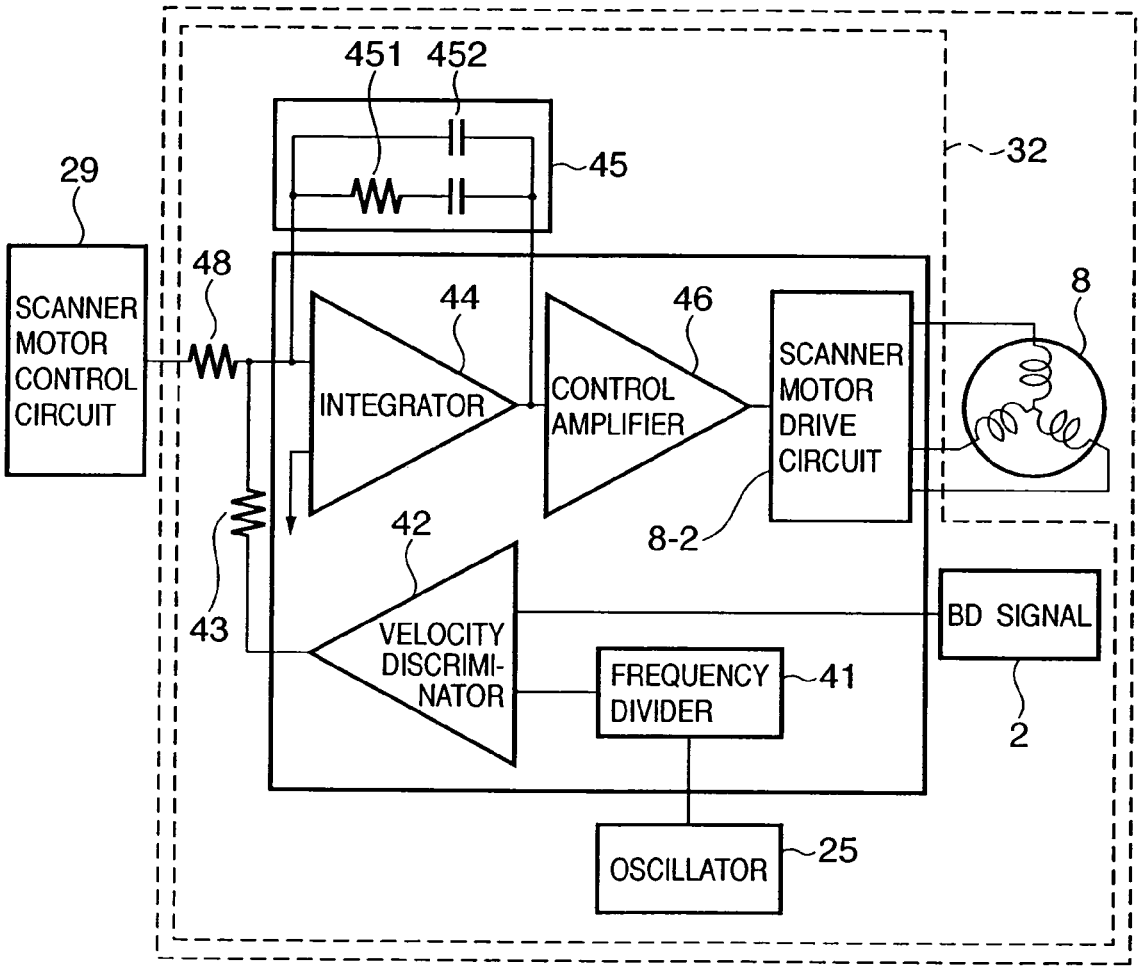
FIG. 13 is a block diagram showing the arrangement of a scanner motor circuit 32 shown in FIG. 11 in detail.

FIG. 13 is a block diagram showing the arrangement of the scanner motor circuit 32 shown in FIG. 11 in detail. The same reference numerals in FIG. 13 denote the same parts as in FIG. 11.

A frequency divider 41 generates a frequency serving as a reference velocity by frequency-dividing reference clocks of an oscillator 25 at a predetermined frequency division ratio.

A velocity discriminator 42 discriminates the velocity of the polygon mirror 7 by comparing the BD signal 2 used to detect the rotation velocity of the polygon mirror 7 arranged on the scanner motor 8, and the output from the frequency divider 41 that generates the frequency serving as the reference velocity of the polygon mirror 7.

An integrator 44 operates as an integrator which receives a control signal from the scanner motor control circuit 29 via a resistor 48, and that from the velocity discriminator 42 via a resistor 43, and has a predetermined gain and frequency characteristics, which are determined by an integration filter 45 including a resistor 451 and capacitor 452.

A control amplifier 46 amplifies the output signal from the integrator 44 to a predetermined gain to drive the scanner motor 8. A scanner motor drive circuit 8-2 comprises a transistor and the like, and drives the scanner motor main body 8.

<Control of Scanner Motor 8>

The control of the scanner motor 8 will be described below. In the scanner motor circuit 32 with the above arrangement, the velocity discriminator 42 monitors if the BD signal 2 reaches a predetermined velocity, and a feedback loop is formed to increase the velocity when the predetermined velocity is not reached, or to decrease the velocity when the predetermined velocity is exceeded.

Since this control loop does not include any control based on the phase difference between the BD signal 2 and the output from the frequency divider, as the frequency serving as the reference velocity, the velocity is controlled by the offset voltage of the integrator 44 to be slightly offset from the predetermined velocity.

In order to faithfully control to the predetermined velocity as a target, a PLL (Phase Locked Loop) velocity control loop that inputs the phase difference output between the reference BD signal 33 obtained by the scanner motor control circuit 29 shown in FIG. 12, and the actual BD signal 2 to the integrator 44 parallel to the loop of the velocity discriminator 42 can be added.

The gain of the PLL velocity control loop can be considerably lower than that of the velocity discriminator 42, and the gain of the velocity discriminator 42 can be set to be 10 times or more of that of the PLL velocity control loop (for example, the resistor 43 is set to be 10 times or more compared to that on the PLL velocity control loop).

This is because the followability to a target value improves but pull-in characteristics to the lock impair when the gain of the PLL velocity control loop is high. By adding the PLL velocity control loop based on the phase difference between the reference BD signal and actual BD signal, the scanner motor 8 can undergo rotation control at the velocity at which the actual BD signal is generated at the period of the reference BD signal.

<Control Timing of Scanner Motor>

Figure 14:
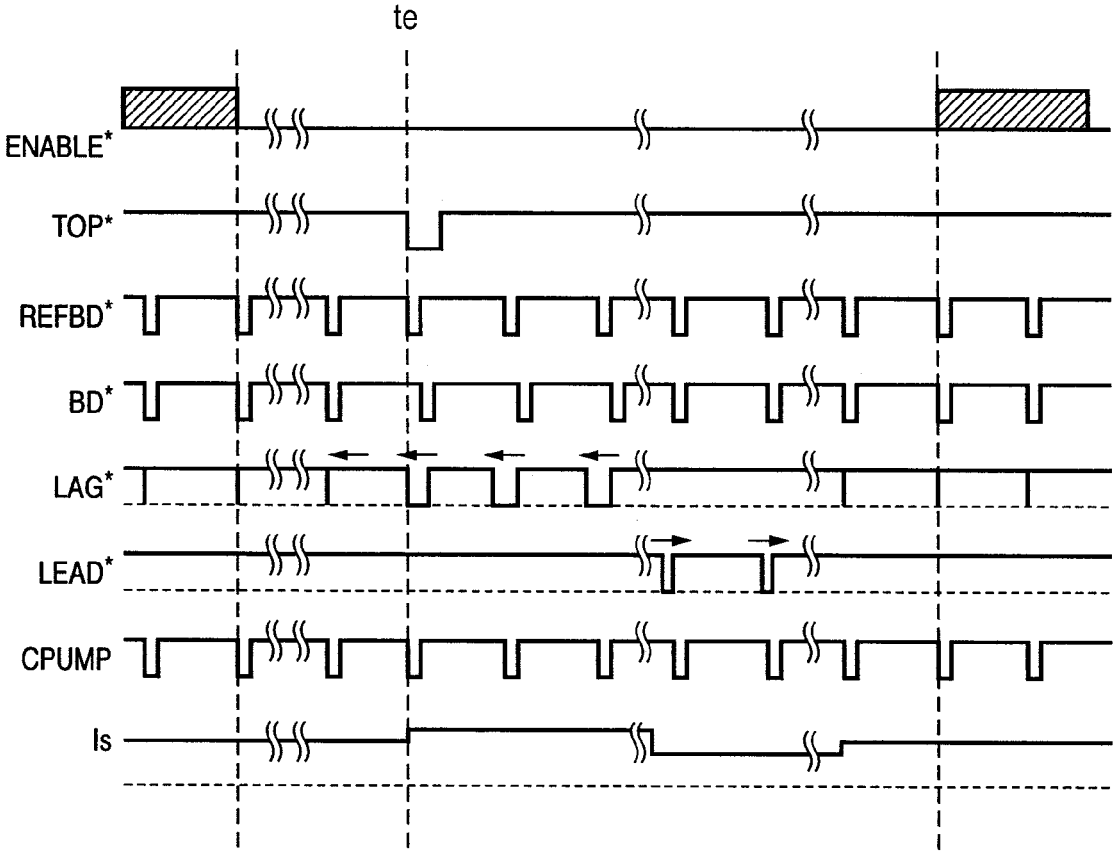
FIG. 14 is a timing chart for explaining a PLL control operation of the scanner motor.

The PLL control operation in the image forming apparatus, which controls the scanner motor 8 by the scanner motor control circuit 29 and scanner motor circuit 32 will be described below. FIG. 14 is a timing chart of the PLL control operation that controls the scanner motor 8. Referring to FIG. 14, "ENABLE*" is a signal indicating a print/non-print region (a non-latent image forming interval in the sub-scan direction of the photosensitive drum 3); a hatched "High" interval indicates the print region, and the remaining interval indicates the non-print region.

"TOP*" is an ITOP signal, which is generated by the top signal generator 22 as a print start sync signal in the sub-scan direction.

"REFBD" is a reference BD signal, which is generated by the counter 31.

"BD*" is a BD signal which is generated by the beam detect signal (BD signal) generation circuit 200 as a print start sync signal in the main scan direction.

Before the ITOP signal (TOP*) is generated by the top signal generator 22, the scanner motor 8 undergoes PLL velocity control so that the phases of the reference BD signal (REFBD*) and actual BD signal (BD*) are synchronized by the velocity discriminator control and PLL control.

After the TOP signal (TOP*) is generated, the counter 31 which generates the reference BD signal (REFBD*) is cleared in response to the trailing edge (a position indicated by "te" in FIG. 14) of the TOP signal (TOP*), and restarts a count operation, thus re-generating a new reference BD signal (REFBD*).

In this case, the actual BD signal (BD*) is kept output at a period intact since the velocity of the scanner motor 8 cannot be abruptly varied.

"LAG*" is a LAG signal which indicates a lag of the phase of the actual BD signal (BD*) from that of the reference BD signal (REFBD*), and is output from the phase comparison circuit 34.

"LEAD*" is a LEAD signal which indicates a phase lead of the actual BD signal (BD*) from that of the reference BD signal (REFBD*), and is output from the phase comparison circuit 34. Note that this LEAD signal (LEAD*) goes "High" only when the phase of the actual BD signal (BD*) lags behind that of the reference BD signal (REFBD*). Also, the LEAD signal (LEAD*) goes "Low" only when the phase of the actual BD signal (BD*) leads that of the reference BD signal (REFBD*).

More specifically, as the outputs from the phase comparison circuit 34, when the phase of the actual BD signal (BD*) lags behind that of the reference BD signal (REFBD*), the LAG signal (LAG*) is kept at "Low", and the LEAD signal (LEAD*) is kept at "High". When the phase leads, the LEAD signal (LEAD*) is kept at "low" and the LAG signal (LAG*) is kept at "High".

"CPUMP" is a mixed signal of the LAG signal (LAG*) and LEAD signal (LEAD*) output from the phase comparison circuit 34, and is generated by the charge pump circuit 35. When the phase lags, since the scanner motor 8 must be accelerated, the charge pump circuit 35 outputs a "+" voltage; when the phase leads, since the scanner motor 8 must be decelerated, it outputs a "−" voltage.

"Is" is a current which is actually output to the scanner motor 8.

Since these control signals are input to the scanner motor circuit 32 as PLL control, the scanner motor 8 is controlled to be slightly accelerated from the current velocity so as to reduce the phase lag, and is kept controlled when a phase balance is kept. That is, the phase of the actual BD signal (BD*) is synchronized with that of the reference BD signal (REFBD*), and the velocity difference becomes completely zero. Their phase difference becomes stable when the velocity discriminator 42 cancels velocity deviation and keeps a balance.

When a print operation starts from a time at which a phase balance between the actual BD signal (BD*) and reference BD signal (REFBD*) is kept, print positions of respective colors (print start positions in the sub-scan direction) can be accurately matched. Furthermore, since the scanner motor control circuit 29 works to keep a phase balance between the actual BD signal (BD*) and reference BD signal (REFBD*) during the print operation, the scanner motor 8 is controlled to synchronize the actual BD signal (BD*) and reference BD signal (REFBD*) until the print operation ends.

With the above arrangement, even in an image forming apparatus in which a time period required for the intermediate transfer belt to make one rotation is not set as an integer multiple of the BD period, the phases of the main scan sync signal (BD signal) and sub-scan sync signal (ITOP signal) can be synchronized.

<Description of Image Forming Operation>

The flow of the image forming operation in the image forming apparatus will be described below.

Upon reception of a job start request, the image forming apparatus performs an initialize operation of image formation preparation under the overall control of the CPU 306, and then launches an ITOP (image top) signal generation counter in which a target value is set for each color, in response to an electrical TOP signal generated on the basis of processing of a program as a trigger. The ITOP signal generation counters are configured based on the counter 31 of FIG. 5.

When the Y counter for the first color reaches a target value, video data request signals are generated. The top signal generator 22 generates a Y ITOP signal (image top signal) based on the video data request signals.

In response to this signal, the laser control unit 26 controls the write start timing of the laser unit 6 to output a laser beam, thus writing a latent image of Y data on the photosensitive drum 3.

The drum motor control unit 28 rotates the photosensitive drum 3 to visualize the latent image by Y toner at a position where the photosensitive drum 3 contacts the Y toner unit. The drum motor control unit 28 further rotates the photosensitive drum 3 to primarily transfer Y data onto the intermediate transfer belt 4 at a position where photosensitive drum 3 contacts the intermediate transfer belt 4.

Next, the drum motor control unit 28 rotates the developer rotary 10 through about 90° to prepare for the next M development. In image formation associated with M data, the M counter in which a target value is set is launched in response to the ITOP signal generated during the Y image formation as a trigger. When the M counter for the second color reaches a target value, video data request signals are generated. The top signal generator 22 generates an M ITOP signal (image top signal) based on the video data request signals.

In response to this signal, the laser control unit 26 controls the write start timing of the laser unit 6 to output a laser beam at a position where the write start position and the rotation position of the intermediate transfer belt 4 are the same as those in case of Y, thus writing a latent image of M data on the photosensitive drum 3.

The drum motor control unit 28 rotates the photosensitive drum 3 to visualize the latent image by M toner at a position where the rotation position of the intermediate transfer belt 4 is the same as that in case of Y. The drum motor control unit 28 further rotates the photosensitive drum 3 to primarily transfer M data onto the intermediate transfer belt 4 at a position where the rotation position of the intermediate transfer belt 4 is the same as that in case of Y.

Next, the same control (image forming process) is applied to C and BK to overlay four toner images on the intermediate transfer belt 4. The secondary transfer roller 11 contacts the intermediate transfer belt 4 to secondarily transfer these toner images onto a fed printing sheet 17, and the transferred toner images are fixed by a fixing device 16. After that, the printing sheet 17 is exhausted.

Figure 4:
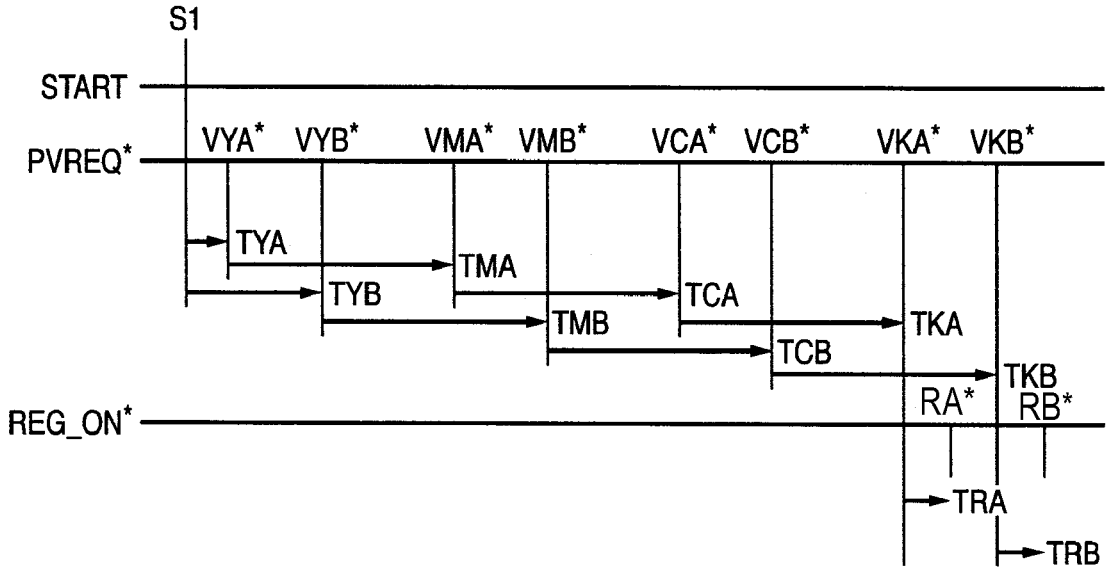
FIG. 4 is a chart for explaining the generation sequence of image top signals (ITOP signals) of respective colors upon executing color print processing of a plurality of pages.

FIG. 4 is a chart of the generation sequence of image top signals (ITOP signals) for respective colors upon executing color print processing of a plurality of pages. The intermediate transfer belt 4 allows two-page attachment of, e.g., A4 printing sheets per perimeter. FIG. 4 shows the generation sequence of image top signals (ITOP signals) for respective colors in case of color image formation of two-page attachment of small-size sheets (e.g., A4).

Initially, the counter 31 simultaneously starts counting using a yellow A face (YA) counter (for an odd page) and yellow B face (YB) counter (for an even page) in response to an electrical START signal (S1) generated based on a program as a trigger.

The yellow A face (YA) counter and yellow B face (YB) counter respectively generate VYA* and VYB* as video data request signals (PVREQ*) in correspondence with the A and B faces of Y when predetermined count times (TYA and TYB) are reached. The top signal generator 22 generates ITOP signals based on video data request signals VYA* and VYB*.

The laser control unit 26 controls the write start timing of the laser unit 6 to output a laser beam from the laser unit 6, thus writing latent images of Y data on the photosensitive drum 3.

Next, a magenta A face (MA) counter and a magenta B face (MB) counter generate VMA* and VMB* as video data request signals (PVREQ*) in correspondence with the A face (odd page face) and B face (even page face) of M in response to the VYA* and VYB* signals of Y as triggers, when predetermined count times (TMA, TMB) corresponding to times for nearly one rotation of the intermediate transfer belt 4 are reached. The top signal generator 22 generates ITOP signals based on video data request signals VMA* and VMB*.

The laser control unit 26 controls the write start timing of the laser unit 6 to output a laser beam from the laser unit 6, thus writing latent images of M data on the photosensitive drum 3.

In the above explanation, the magenta A face (MA) counter and the magenta B face (MB) counter generate VMA* and VMB* based on the VYA* and VYB* signals of Y as triggers. It is possible to generate VMA* and VMB* by using ITOP signals generated by VYA* and VYB* signals of Y.

Next, the same control is applied to C and BK, thus writing latent images of C and BK data onto the photosensitive drum 3. Specifically, a cyan A face (CA) counter and a cyan B face (CB) counter generate VCA* and VCB* as video data request signals corresponding to the A face (odd page face) and B face (even page face) of Cyan in response to the VMA* and VMB* signals of Magenta as triggers, when predetermined count times (TCA, TCB) corresponding to times for one rotation of the intermediate transfer belt 4 are reached. When predetermined count times (TKA, TKB) corresponding to times for one rotation of the intermediate transfer belt 4 are reached, VKA* and VKB* as video data reQuest signals corresponding to the A face (odd page face) and B face (even page face) of BK in response to the VCA* and VCB* signals of Cyan as triggers are generated.

A registration roller ON counter is counted in response to BK video data request signals (PVREQ*) VKA* and VKB* as triggers when four color toner images are overlaid on the intermediate transfer belt 4. $REG_{13}ON$ signals RA*, RB*) are sequentially generated under the control of the CPU 306. The $REG_{13}ON$ signals (RA*, RB*) are generated in response to the VKA* and VKB* signals of BK as triggers, when predetermined times (TRA, TRB) are reached. Printing sheets 17 or the like are fed based on these signals. The secondary transfer roller 11 contacts the intermediate transfer belt 4 to secondarily transfer the toner images onto the sheets.

<Circuit Arrangement of Counter 31>

Figure 5:
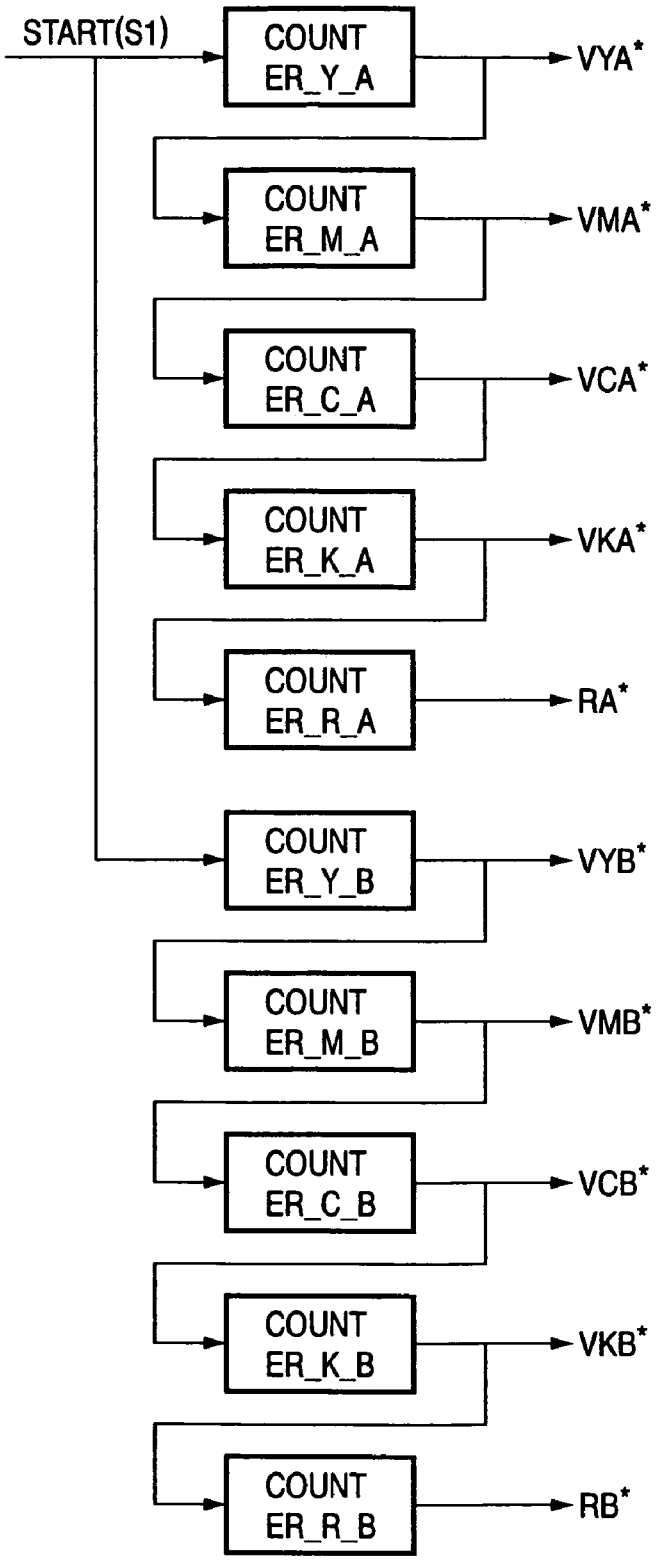
FIG. 5 is a diagram showing the circuit arrangement of a counter 31 according to the first embodiment.

FIG. 5 shows the circuit arrangement of the counter 31 according to the first embodiment. A START signal (S1) is input to yellow (Y) counters A (odd page face) and B (even page face) for the first color. The input/output relationships of respective counters for the subsequent colors after Y are linked together so as to receive video data request signals generated by the counters of the previous colors as launch triggers.

With this arrangement, count target values for respective colors used to distribute a quantization error produced during the sampling period for making perimeter detection to less than one pixel can be independently set for respective colors.

<Processing of Quantization Error>

(Example of Accumulation of Quantization Errors)

When one period of the intermediate transfer belt is measured by the perimeter detection counter 303 and image formation is made as in the prior art, a value (t1+t2) as the sum of counter fractions t1 and t2 becomes a quantization error (perimeter error), and the measurement result is not reflected in the belt perimeter.

Figure 6:
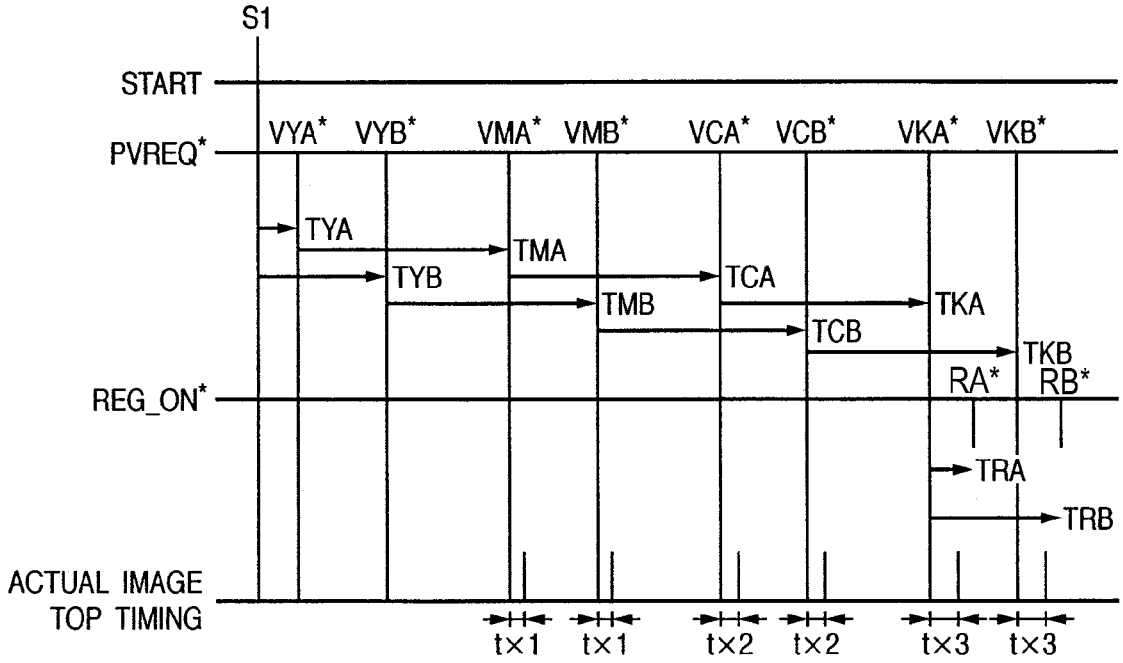
FIG. 6 is a chart for explaining an example of accumulated quantization errors upon rotation of the intermediate transfer belt.

An example of accumulation of quantization errors as the intermediate transfer belt rotates will be described below. FIG. 6 is a chart obtained by adding a quantization error (t) of an actual image top timing (actual image formation start timing) to the sequence chart of FIG. 4. As shown in FIG. 6, a time period in which a video data request signal (PVREQ*) of each color is generated is practically defined as a time period which falls short by the aforementioned quantization error t from the actual image top timing.

For example, paying attention to only the A face, a deviation of a quantization error t for a fraction is sequentially added to count times (TMA, TCA, TKA) during four-color image formation, and the image formation start positions of Y (yellow) and BK (black) consequently have deviations of quantization error t×3, as shown in FIG. 6.

(Example of Distributing Quantization Error By Setting Target Value of Counter)

Figure 7A:
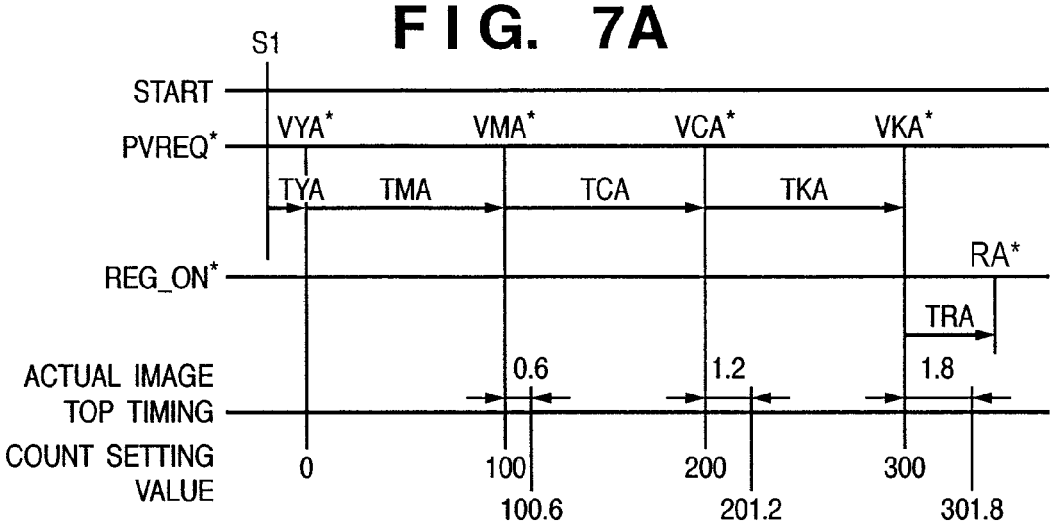
FIGS. 7A to 7C are charts for explaining an example of distributing a quantization error by setting a target value of the counter according to the first embodiment.
Figure 7B:
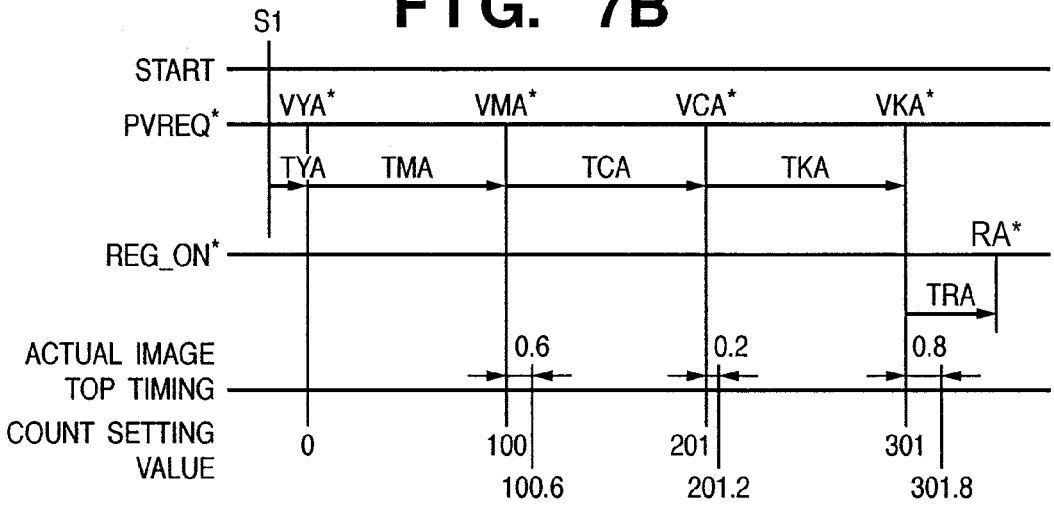
Figure 7C:
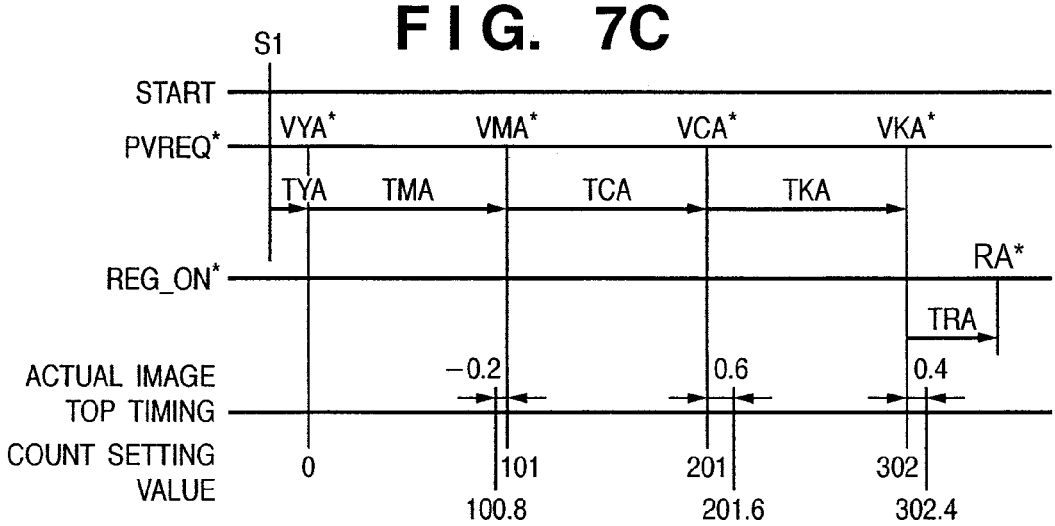
Figure 15:
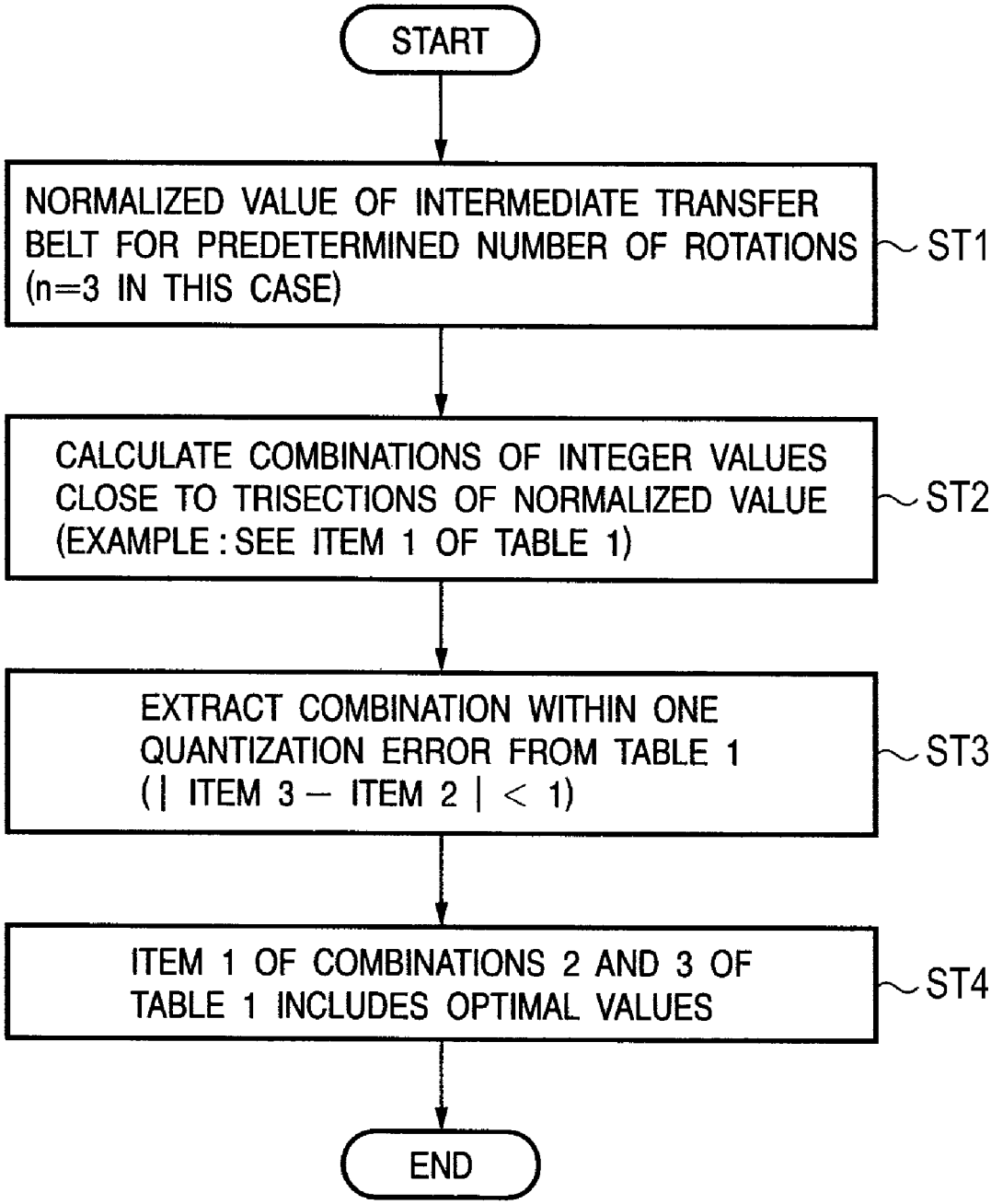
FIG. 15 is a flowchart for explaining the flow of processing for distributing a quantization error by setting a target value of the counter according to the first embodiment.

A practical example of distributing quantization errors by setting target values of the counters in this embodiment will be described below. FIGS. 7A to 7C show a practical example of distributing quantization errors by setting target values of the counters in the first embodiment. FIG. 15 is a flowchart for explaining the flow of processing for distributing quantization errors by setting target values of the counters in the first embodiment. FIG. 16 shows practical numerical values used to explain the processing shown in FIG. 15. The flowchart shown in FIG. 15 is executed using a program stored in the ROM 24 and a RAM (not shown) under the control of the CPU 306.

In this embodiment, the perimeter detection counter 307 measures the perimeter of the intermediate transfer belt 4 taking three rotations of the intermediate transfer belt 4 as an example, as described above. In FIGS. 7A, 7B, and 7C, the actual image top timing (actual image formation start timing) and data associated with distribution of count setting values are added to the sequence chart in FIG. 4. Note that the actual belt perimeter is specified as 100.6 and the sampling period is 1, paying attention to only the counter operation of the A face (odd page face), for the sake of simplicity.

Assume that the actual belt perimeter is 100.6. For example, when distribution of quantization errors is not considered as in the processing of the sequence chart of FIG. 6, and one period of the intermediate transfer belt 4 is measured by the perimeter detection counter 307, a fraction=0.6 is canceled, the belt perimeter is normalized to 100, and a quantization error (t) per belt perimeter is 0.6, as shown in FIG. 7A.

Therefore, as shown in FIG. 6, a deviation of a quantization error t for a fraction is sequentially added to count times (TMA, TCA, TKA) during four-color image formation, and the image formation start positions of Y and BK consequently have deviations of quantization error t×3=1.8, a shown in FIG. 7A.

FIG. 7B shows an example of distributing the quantization errors (=1.8) in FIG. 7A. In this case, a value for three periods of the intermediate transfer belt 4 is 100.6×3=301.8, and a value normalized by canceling a fraction =0.8 (normalized value) is 301 (ST1 in FIG. 15). In order to suppress an error to less than one quantization error for the normalized value=301, a combination of integer values close to trisections of the normalized value=301 is calculated (ST2 in FIG. 15; item 1 of combinations 1 to 3 in FIG. 16). Next, a combination that can suppress an error to less than one quantization error is determined (ST3 and ST4 in FIG. 15; items 4 and 5 in FIG. 16). Upon determining a combination, if it is determined in step ST4 in FIG. 15 that item 1 of combination 2 in FIG. 16 can suppress an error to less than one quantization error, the step of determining if item 1 of next combination 3 can suppress an error to less than one quantization error may be skipped.

Next, the values (100, 101, and 100) of item 1 of combination 2 shown in FIG. 16 that can suppress an error to less than one quantization error are distributed to the counter target values (TMA, TYA, TKA) (the distribution method is not limited to an example of FIG. 15, and the CPU or the like may execute arithmetic processing using the normalized value and the number of continuous rotations to suppress an error to less than one quantization error). As a result, errors at actual image top positions as the image formation start positions of respective colors are respectively 0.6, 0.2, and 0.8, and an error can be suppressed to less than one quantization error.

FIG. 7C shows another example associated with distribution of counter target values. In this case, assuming that the actual belt perimeter is 100.8, a value for three periods of the intermediate transfer belt 4 is 100.8×3=302.4. Also, a fraction=0.4 is canceled, and a normalized value for three periods of the intermediate transfer belt 4 is 302. In case of the normalized value=302, the arithmetic processing is executed in the same manner as described above and, for example, the counter target values (TMA, TYA, TKA) are distributed to 101, 100, and 101. As a result, errors at actual image top positions as the image formation start positions of respective colors are respectively −0.2, 0.6, and 0.4, and an error can be suppressed to less than one quantization error.

As described above, according to this embodiment, since the count target values of respective colors are set, a problem of color misregistration due to quantization errors produced during the sampling period for making perimeter detection can be avoided. Since image top signals (ITOP signals) of respective colors are generated in nearly synchronism with actual image top timings, a high-quality image can be formed without causing any large color misregistration.

Second Embodiment

The arrangement of this embodiment is substantially the same as that in the first embodiment, except that the perimeter detection of the intermediate transfer belt 4 can measure only two rotations on the ground of the image formation sequence and the like of the printer.

Figure 8:
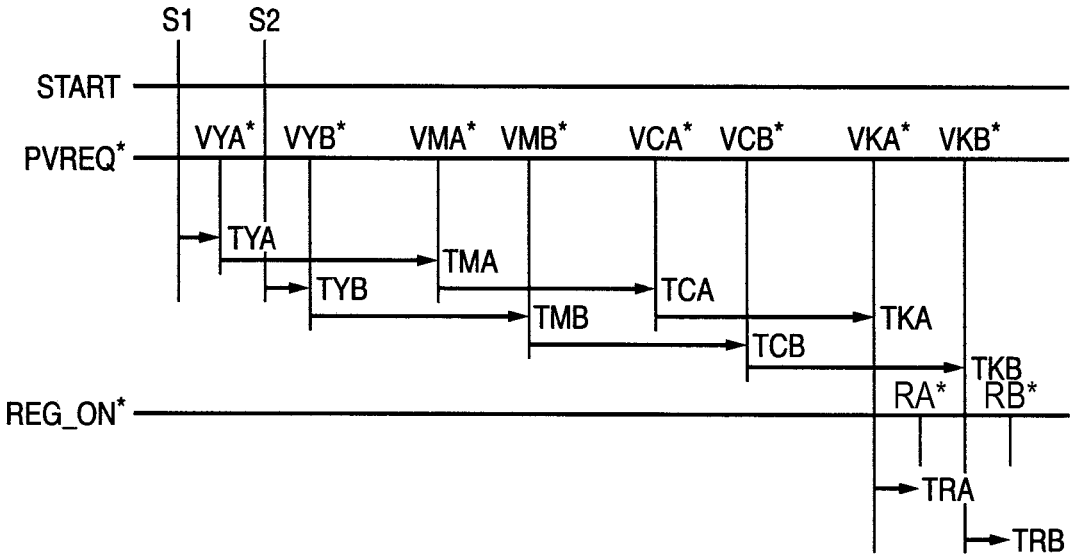
FIG. 8 is a chart for explaining the generation sequence of image top signals (ITOP signals) of respective colors upon executing color print processing according to the second embodiment.

FIG. 8 is a chart for explaining the generation sequence of image top signals (ITOP signals) in color print processing of the second embodiment. FIG. 8 shows basically the same generation sequence of image top signals without START signals.

The intermediate transfer belt 4 allows two-page attachment of A4 printing sheets per perimeter, as in the first embodiment. FIG. 8 shows the generation sequence of image top signals (ITOP signals) for respective colors in case of color image formation of two-page attachment of small-size sheets (e.g., A4).

A yellow A face (YA) counter and yellow B face (YB) counter start counting in response to electrical START signals (S1, S2), which are generated based on a program and respectively correspond to the A face (odd page face) and B face (even page face), as triggers.

The yellow A face (YA) counter and yellow B face (YB) counter generate VYA* and VYB* as video data request signals (PVREQ*) in correspondence with the A and B faces of Y when predetermined count times (TYA, TYB) are reached. The top signal generator 22 generates ITOP signals based on video data request signals VYA* and VYB*.

The laser control unit 26 controls the write start timing of the laser unit 6 to output a laser beam from the laser unit 6, thus writing latent images of Y data on the photosensitive drum 3.

Next, a magenta A face (MA) counter and magenta B face (MB) counter generate VMA* and VMB* as video data request signals (PVREQ*) in correspondence with the A face (odd page face) and B face (even page face) of M in response to the VYA* and VYB* signals of Y as triggers, when predetermined count times (TMA, TMB) corresponding to times for nearly one rotation of the intermediate transfer belt 4 are reached. The top signal generator 22 generates ITOP signals based on video data request signals VMA* and VMB*.

The laser control unit 26 controls the write start timing of the laser unit 6 to output a laser beam from the laser unit 6, thus writing latent images of M data on the photosensitive drum 3.

Next, the same control is applied to C and BK, thus writing latent images of C and BK data onto the photosensitive drum 3.

A registration roller ON counter is counted in response to BK video data request signals (PVREQ*) VKA* and VKB* as triggers when four color toner images are overlaid on the intermediate transfer belt 4. REG_ON signals (TRA, TRB) are sequentially generated under the control of the CPU 306. Printing sheets 17 or the like are fed based on these signals. The secondary transfer roller 11 contacts the intermediate transfer belt 4 to secondarily transfer the toner images onto the sheets.

<Circuit Arrangement of Counter 31>

Figure 9:
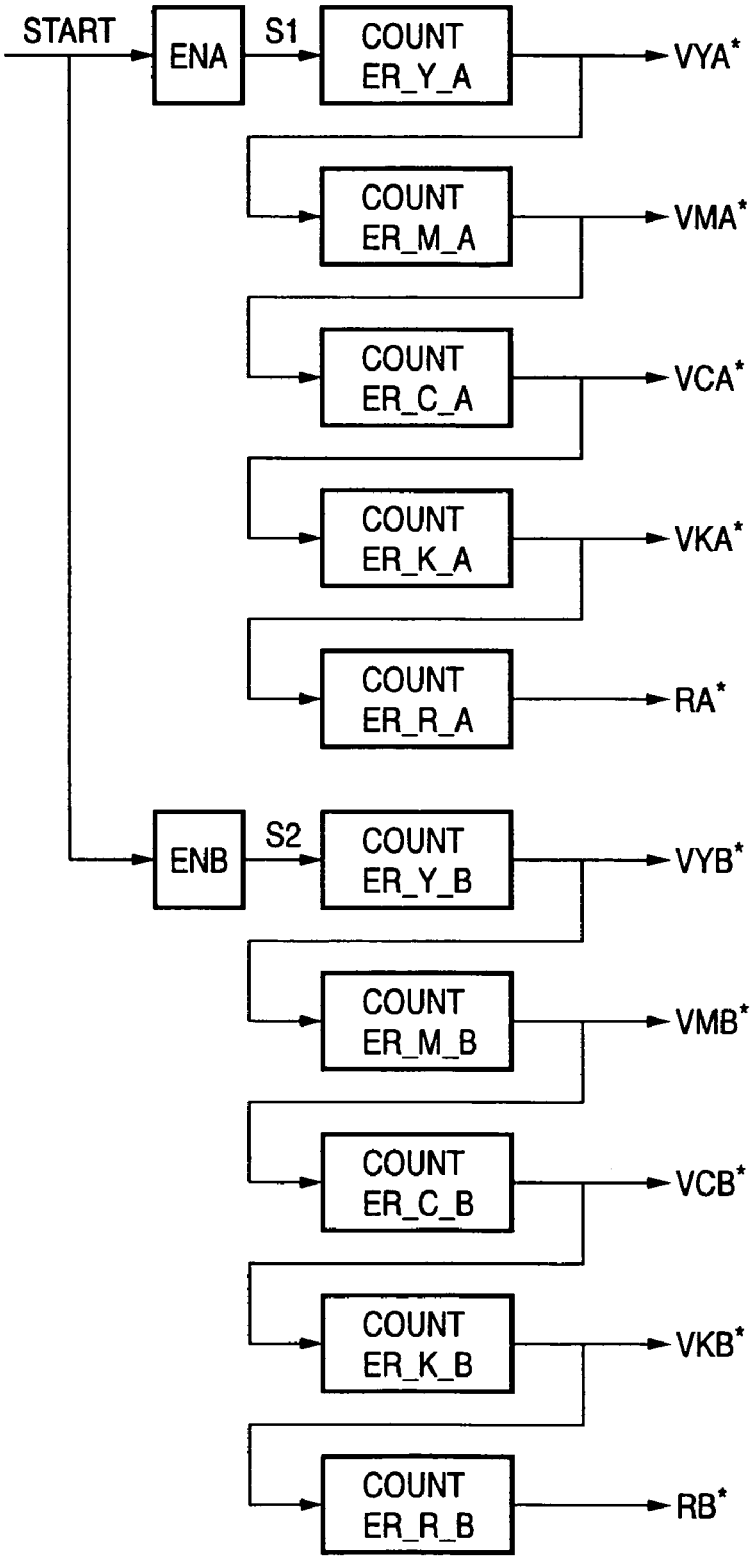
FIG. 9 is a diagram showing the circuit arrangement of a counter 31 according to the second embodiment.

FIG. 9 shows the circuit arrangement of the counter 31 according to the second embodiment. FIG. 9 shows basically the same circuit arrangement of FIG. 5 without ENABLE_A (ENA) and ENABLE_B (ENB).

The counter circuit 31 has gates ENABLE_A (ENA) and ENABLE_B (ENB) before the Y counters A and B for the first color. These gates are turned on/off in a toggle manner under the control of the CPU 306, thus inputting START signals for the A and B faces. The input/output relationships of respective counters for the subsequent colors after Y are linked together so as to receive video data request signals generated by the counters of the previous colors as launch triggers.

With this arrangement, count target values for respective colors used to distribute a quantization error produced during the sampling period for making perimeter detection to less than one pixel can be independently set for respective colors.

Figure 10A:
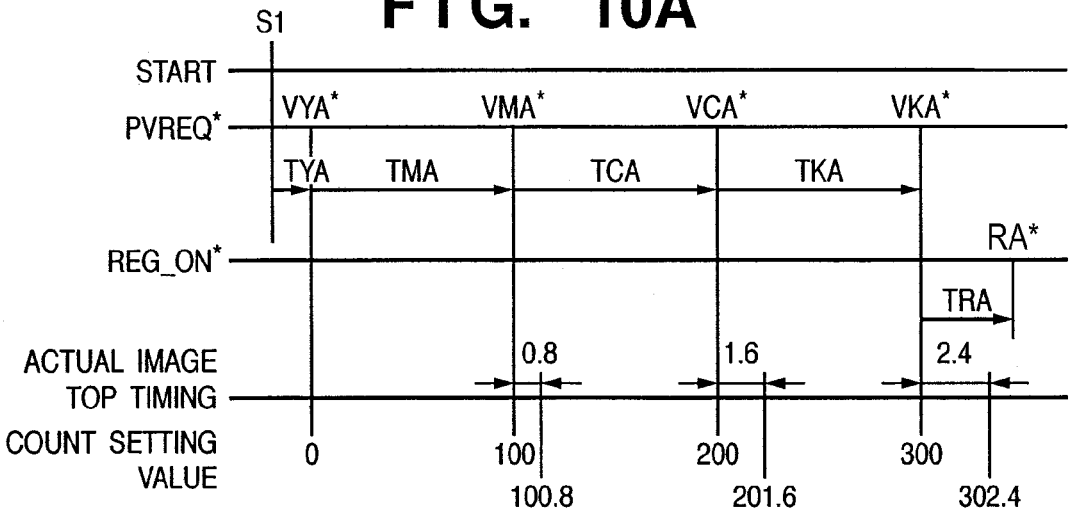
FIGS. 10A to 10C are charts showing a practical example of distributing a quantization error by setting a target value of the counter according to the second embodiment.
Figure 10B:
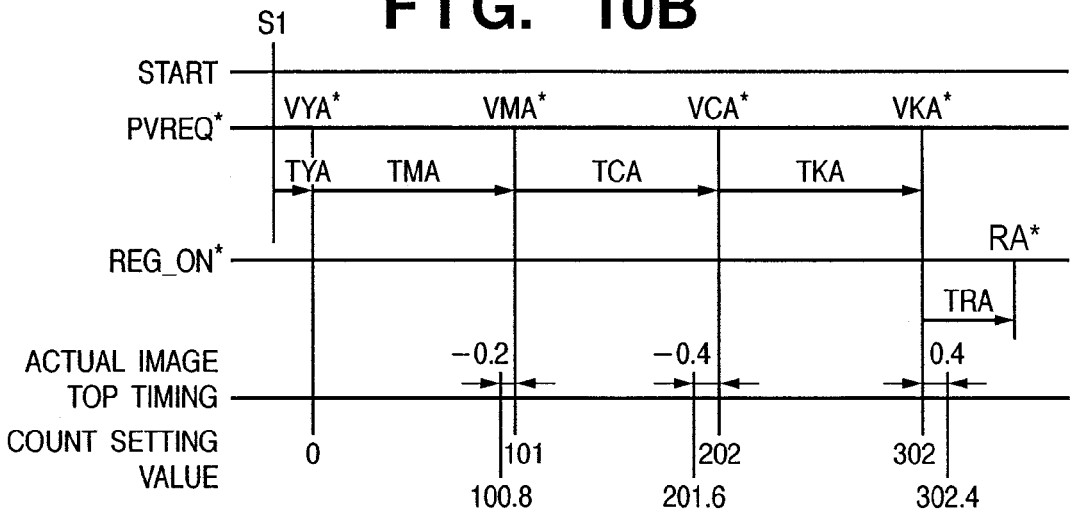
Figure 10C:
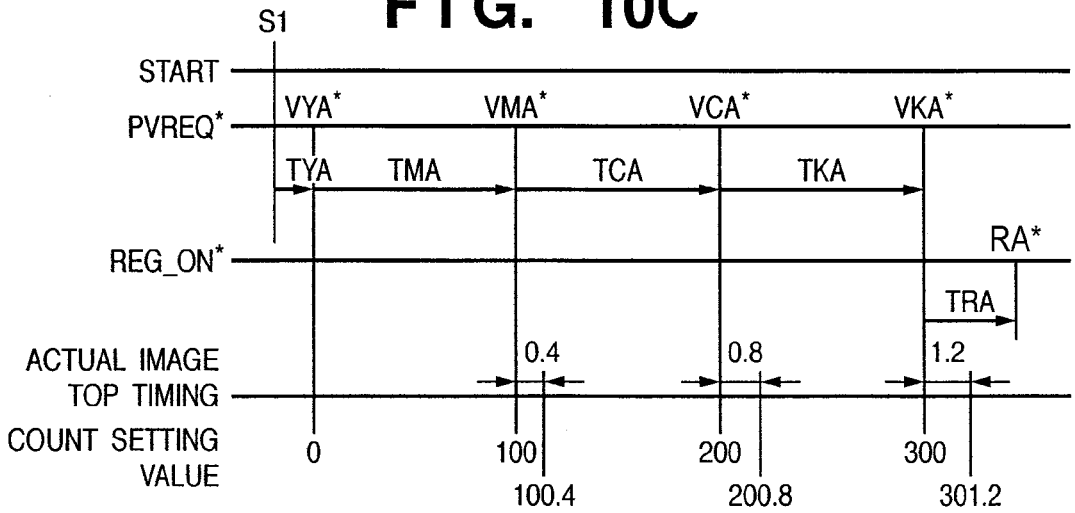

A practical example of distributing quantization errors by setting target values of the counters in this embodiment will be described below. FIGS. 10A to 10C show a practical example of distributing quantization errors by setting target values of the counters in the second embodiment. In this embodiment, the perimeter detection counter 307 measures the perimeter of the intermediate transfer belt 4 taking two rotations of the intermediate transfer belt 4 as an example. In FIGS. 10A, 10B, and 10C, the actual image top timing (actual image formation start timing) and data associated with distribution of count setting values are added to the sequence chart in FIG. 8. Note that the actual belt perimeter is specified as 100.8 and the sampling period is 1, paying attention to only the counter operation of the A face (odd page face), for the sake of simplicity.

If the actual belt perimeter is 100.8, and one period of the intermediate transfer belt 4 is measured by the perimeter detection counter as in the prior art, a fraction=0.8 is canceled, the belt perimeter is normalized to 100, and a quantization error (t) is 0.8, as shown in FIG. 10A.

Therefore, a deviation of a quantization error t=0.8 for a fraction is sequentially added to count times (TMA, TCA, TKA) during four-color image formation, and the image formation start positions of Y and BK consequently have deviations of quantization error t×3=2.4, a shown in FIG. 10A.

FIG. 10B shows an example of distributing the quantization errors for two periods of the intermediate transfer belt 4. In this case, a value for two periods of the intermediate transfer belt 4 is 100.8×2=201.6, and is normalized to a normalized value=201 by canceling a fraction=0.6. The arithmetic processing is executed in the same manner as in the above description, and actual counter target values (TMA, TYA, TKA) are distributed to, e.g., 101, 101, and 100 on the basis of the normalized value=201. As a result, errors at actual image top positions as the image formation start positions of respective colors are respectively −0.2, −0.4, and 0.4, and an error can be suppressed to less than one quantization error.

FIG. 10C shows another example associated with distribution of counter target values. In this case, if the actual belt perimeter is 100.4, a measured value for two rotations of the intermediate transfer belt 4 is 100.4×2=200.8, and is normalized to a normalized value=200 by canceling a fraction=0.8. The arithmetic processing is executed in the same manner as in the above description, and actual counter target values (TMA, TYA, TKA) are distributed to, e.g., 100, 100, and 100 even in case of the normalized value=200. As a result, errors at actual image top positions as the image formation start positions of respective colors are respectively 0.4, 0.8, and 1.2, and an error can be suppressed to less than two quantization errors.

Therefore, even when a value detected by belt perimeter detection is for two periods, actual color misregistration can be easily suppressed compared to errors, i.e., quantization errors 2.4 which are produced when only one period of the belt perimeter is measured, as described in the first embodiment.

In this embodiment as well, since the count target values of respective colors are set, a problem of color misregistration due to quantization errors produced during the sampling period for making perimeter detection can be avoided. Since image top signals (ITOP signals) of respective colors are generated in nearly synchronism with actual image top timings, a high-quality image can be formed without causing any large color misregistration.

Other Embodiments

In the aforementioned image forming apparatus, toner images of four colors are overlaid on the intermediate transfer body to form an image. Alternatively, toner images of five or six colors may be overlaid. In this case, the number of counters may be increased accordingly.

In the aforementioned image forming apparatus, respective toner images are overlaid on the intermediate transfer body to form an image on a printing medium. This control can also be applied to a case wherein toner images of a plurality of colors are directly overlaid on a photosensitive belt or drum to form an image on a printing medium.

The objects of the present invention are also achieved by supplying a storage medium, which records a program code of a software program that can implement the functions of the above-mentioned embodiments to the system or apparatus, and reading out and executing the program code stored in the storage medium by a computer (or a CPU or MPU) of the system or apparatus. In this case, the program code itself read out from the storage medium implements the functions of the above-mentioned embodiments, and the storage medium which stores the program code constitutes the present invention. As the storage medium for supplying the program code, for example, a floppy disk, hard disk, optical disk, magneto-optical disk, CD-ROM, CD-R, magnetic tape, nonvolatile memory card, ROM, and the like may be used.

The functions of the above-mentioned embodiments may be implemented not only by executing the readout program code by the computer but also by some or all of actual processing operations executed by an OS (operating system) running on the computer on the basis of an instruction of the program code.

Furthermore, the functions of the above-mentioned embodiments may be implemented by some or all of actual processing operations executed by a CPU or the like arranged in a function extension board or a function extension unit, which is inserted in or connected to the computer, after the program code read out from the storage medium is written in a memory of the extension board or unit.

As described above, when the count target values of respective colors are set within at least one quantization error, a problem of color misregistration due to quantization errors produced during the sampling period for making perimeter detection can be avoided. Since image top signals (ITOP signals) of respective colors are generated in nearly synchronism with actual image top timings, a high-quality image can be formed without causing any large color misregistration.

The present invention has been explained by way of its preferred embodiments. However, the present invention is not limited to the arrangements of these embodiments, and various changes and modifications can be made within the scope of the claims.

As many apparently widely different embodiments of the present invention can be made without departing from the spirit and scope thereof, it is to be understood that the invention is not limited to the specific embodiments thereof except as defined in the claims.

CLAIM OF PRIORITY

This application claims priority from Japanese Patent Application No. 2004-290381 filed on Oct. 1, 2004, which is hereby incorporated by reference herein.

What is claimed is:

1. An image forming apparatus for overlaying toner images of at least first and second colors on an image carrier, and forming the toner images on a printing medium, comprising:

a perimeter count device adapted to count a perimeter of the image carrier on the basis of a reference signal and a sampling period of a clock count; and a target value setting device adapted to set target values of image formation start timings for the respective first and second colors in consideration of a perimeter error of the image carrier due to a quantization error produced upon counting on the basis of the reference signal and the sampling period of the clock count, wherein said target value setting device comprises a request signal generation counter adapted to generate an image formation start request signal for each of the first and second colors on the basis of the set target values of the respective first or second color.

2. The apparatus according to claim 1, wherein said perimeter count device detects a reference mark formed on the image carrier as the reference signal, and continuously counts a period of the image carrier for a predetermined number of rotations as a prescribed value.

3. The apparatus according to claim 1, wherein said target value setting device corrects the quantization error to less than one quantization error for at least one of the first or second color on the basis of a prescribed value.

4. The apparatus according to claim 1, wherein said request signal generation counter counts an output timing of a request signal corresponding to the second color in accordance with the set target value to have an output timing of a request signal corresponding to the first color as a start point.

5. The apparatus according to claim 4, wherein said request signal generation counter has generation units adapted to generate independent request signals corresponding to at least the first and second colors, and the target values are independently settable in said generation units corresponding to the at least first and second colors.

6. An image forming apparatus for forming a toner image on an image carrier, overlaying the toner images of at least first and second colors on an intermediate transfer body, and forming an image on a printing medium, comprising:

a perimeter count device adapted to count a perimeter of the intermediate transfer body on the basis of a reference signal and a sampling period of a clock count; and a target value setting device adapted to set target values of image formation start timings for the respective first and second colors in consideration of a perimeter error of the intermediate transfer body produced upon counting on the basis of the reference signal and the sampling period of the clock count, wherein said target value setting unit comprises a request signal generation counter adapted to generate an image formation start request signal for each of the first and second colors on the basis of the set target values of the respective first or second color.

7. The apparatus according to claim 6, wherein said perimeter count device detects a reference mark formed on the intermediate transfer body as the reference signal, and continuously counts a period of the intermediate transfer body for a predetermined number of rotations as a prescribed value.

8. The apparatus according to claim 6, wherein said target value setting device corrects a quantization error to less than one quantization error for at least one of the first or second color on the basis of a prescribed value.

9. The apparatus according to claim 6, wherein the request signal of each of the first and second colors generated by said request signal generation counter is synchronized with a scan period of a polygonal mirror which aims at forming an electrostatic latent image on the image carrier by scanning a light beam.

10. The apparatus according to claim 6, wherein said request signal generation counter counts an output timing of a request signal corresponding to the second color in accordance with the set target value to have an output timing of a request signal corresponding to the first color as a start point.

11. The apparatus according to claim 6, wherein said request signal generation counter has generation units adapted to generate independent request signals corresponding to at least the first and second colors, and the target values are independently settable in said generation units corresponding to at least the first and second colors.

12. The apparatus according to claim 6, wherein said request signal generation counter further has counters for odd and even pages, and the target values are independently settable in said counters for odd and even pages.

13. A method of controlling an image forming apparatus for overlaying toner images of at least first and second colors on an image carrier, and forming the toner images on a printing medium, comprising:

a perimeter count step of counting a perimeter of the image carrier on the basis of a reference signal and a sampling period of a clock count; and a target value setting step of setting target values of image formation start timings for the respective first and second colors in consideration of a perimeter error of the image carrier due to a quantization error produced upon counting on the basis of the reference signal and the sampling period of the clock count, wherein said target value setting step comprises a step of generating an image formation start request signal for each of the first and second colors on the basis of the set target values of the respective first or second color.

14. A method of controlling an image forming apparatus for forming a toner image on an image carrier, overlaying the toner images of at least first and second colors on an intermediate transfer body, and forming an image on a printing medium, comprising:

a perimeter count step of counting a perimeter of the intermediate transfer body on the basis of a reference signal and a sampling period of a clock count; and a target value setting step of setting target values of image formation start timings for the respective first and second colors in consideration of a perimeter error of the intermediate transfer body due to a quantization error produced upon counting on the basis of the reference signal and the sampling period of the clock count, wherein said target value setting step comprises a step of generating an image formation start request signal for each of the first and second colors on the basis of the set target values of the respective first or second color.

* * * * *